United States Patent [19]

Rynyk

[11] 4,266,900

[45] May 12, 1981

[54] MATERIAL HANDLING APPARATUS

[75] Inventor: Douglas W. Rynyk, Toronto, Canada

[73] Assignee: Canada Square Management Ltd., Toronto, Canada

[21] Appl. No.: 17,309

[22] Filed: Mar. 5, 1979

[30] Foreign Application Priority Data

Jul. 4, 1978 [CA] Canada ..... 306714

[51] Int. Cl.[3] ..... B65G 65/42; B65G 65/58; F23G 3/00

[52] U.S. Cl. ..... 414/285; 110/255; 222/135; 414/176

[58] Field of Search ..... 414/173, 176, 187, 198, 414/268, 285, 325, 327, 519, 520, 528; 198/530, 531, 557, 616; 110/255; 100/229 A; 222/415, 310, 135

[56] References Cited

U.S. PATENT DOCUMENTS

| | | | |
|---|---|---|---|
| 1,535,039 | 4/1925 | Rettler | 414/327 |
| 3,103,301 | 9/1963 | Pierson | 222/415 X |
| 3,377,030 | 4/1968 | Swenson | 414/528 X |
| 3,680,719 | 8/1972 | Reilly | 414/325 |

FOREIGN PATENT DOCUMENTS 791497 8/1968 Canada .

*Primary Examiner*—Robert G. Sheridan
*Attorney, Agent, or Firm*—Rogers, Bereskin & Parr

[57] ABSTRACT

A material handling apparatus is described, for example, for delivering bags of garbage to an incinerator. The apparatus includes a plurality of material-receiving compartments, each having a first end at which material can be loaded into the compartment, and a second end from which material can be discharged. Each compartment includes a belt conveyor which forms a bottom wall of the compartment and which is operable to move material longitudinally of the compartment in a direction towards said second end. Side walls of the compartment extend upwardly adjacent respective the opposite sides of the conveyor for laterally constraining material in the compartment. The compartment also includes closure means normally preventing discharge of material from said second end of the compartment, said closure means being adapted to be opened at appropriate times to allow material to be discharged from said compartment by operating the belt conveyor. The apparatus also includes a further belt conveyor positioned to receive material discharged from said compartments and operable to deliver said material to a common discharge location.

1 Claim, 5 Drawing Figures

MATERIAL HANDLING APPARATUS

This invention relates to a material handling apparatus. In particular, the invention has been devised in connection with the handling of combustible waste material such as bags of garbage and the like intended to be delivered to an incinerator for fuel. However, the invention is not limited to this particular application.

It has previously been proposed to use garbage as a fuel source for heating and/or cooling buildings in which large amounts of combustible waste material are ordinarily available, such as office buildings, hospitals and the like. By way of example, our Canadian patent application No. 284,929 filed Aug. 18, 1977 is concerned with a heating and cooling system for a building which includes an incinerator intended to be fueled by combustible waste material from the building.

While the desirability of conserving energy by using garbage as a fuel source is widely acknowledged, problems have been encountered in providing means for efficiently handling garbage to be delivered to an incinerator. One example of a prior art garbage handling installation used in a hospital includes an open-topped hopper for receiving bags of garbage collected by hospital personnel. The hopper has an opening at its lower end controlled by a gate arrangement intended to allow garbage to be periodically removed from the hopper. A A conveyor belt is disposed below the hopper for delivering the garbage to an incinerator. In practice, it is found that the hopper often becomes jammed with bags of garbage to the extent that the garbage bags will not pass through the outlet opening of the hopper when the gate arrangement is opened. In fact, practical tests have shown that the garbage bags become so tightly jammed in the hopper that they often cannot be disloged even by forcing a knife or other tool downwardly through the garbage bags or by attempting to pull the bags down from below.

Canadian patent application Ser. No. 301,980 filed Apr. 26, 1978 is directed to one form of material handling apparatus intended to avoid the problem referred to above.

An object of the present invention is to provide an alternative form of material handling apparatus also intended to avoid the problem of jamming of the material being handled.

According to the present invention, the apparatus includes a plurality of material-receiving compartments, each having a first end at which material can be loaded into the compartment, and a second end from which material can be discharged. Each compartment includes a belt conveyor which forms a bottom wall of the compartment and which is operable to move material longitudinally of the compartment in a direction towards said second end. Side walls of the compartment extend upwardly adjacent respective the opposite sides of the conveyor for laterally constraining material in the compartment. The compartment also includes closure means normally preventing discharge of material from said second end of the compartment, said closure means being adapted to be opened at appropriate times to allow material to be discharged from said compartment by operating the belt conveyor. The apparatus also includes a further belt conveyor positioned to receive material discharged from said compartments and operable to deliver said material to a common discharge location.

In order that the invention may be more clearly understood, reference will now be made to the accompanying drawings which illustrate one embodiment of the invention by way of example, and in which.

Figure 1:
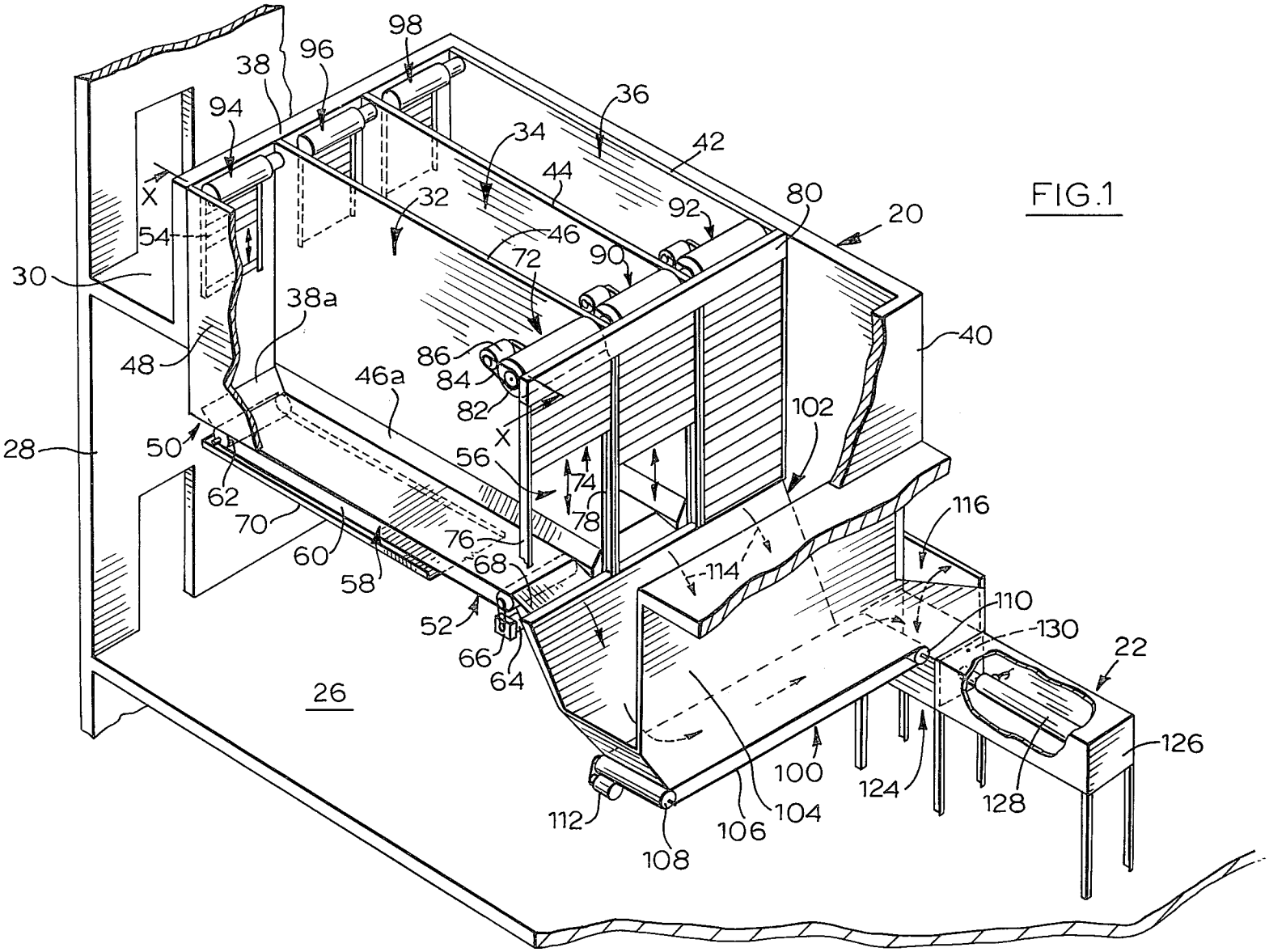
FIG. 1 is a perspective view of a material handling apparatus according to the invention intended to be used in association with an incenerator.

Referring first to FIG. 1, the material handling apparatus is generally indicated at 20 and is intended for handling bags of garbage to be fed to an incenerator. The incinerator itself is hidden in FIG. 1, although that view does show a device 22 for feeding into the incinerator, bags of garbage received from apparatus 20. The incinerator is shown at 24 in FIG. 2 in association with device 22.

In this embodiment, the installation comprising apparatus 20 and incinerator 24 is intended to be used in an office building or the like for handling and burning garbage produced in the building, and incinerator 24 operates as a heating source for the building's heating system (not shown). The installation is housed in a suitable room in the building (as a conventional furnace room); in FIG. 1, part of the floor of the furnace room is indicated at 26 and part of the wall is denoted 28. The incinerator 24 is supported on floor 26, although, as mentioned previously, the incinerator itself is not visible in FIG. 1. An overhead walkway 30 provides access to apparatus 20 for service personnel to load bags of garbage into the apparatus. Suitable supports will of course be provided for apparatus 20, although, for the sake of clarity of illustration, they have not been shown in FIG. 1.

Apparatus 20 includes three compartments 32, 34 and 36 defined by end walls 38 and 40, and side walls 42, 44, 46, and 48. Part of wall 48 is broken away to show the interior of compartment 32, which compartment will now be described as representative of all three compartments. Compartment 32 has a first end 50 at which bags of garbage can be loaded into the compartment, and a second end 52 from which the bags can be discharged. Wall 38 at the first end 50 of compartment 32 includes an opening 54 through which the bags are loaded into the compartment. A discharge opening 56 at the second end 52 of compartment 32 allows the bags to be discharged from the compartment at appropriate times.

A belt conveyor generally denoted 58 forms a bottom wall of compartment 32 and is operable to move material longitudinally of the compartment in a direction towards the second end 52, i.e. towards discharge opening 56. Conveyor 58 includes an endless belt 60 which runs around parallel rollers 62 and 64 disposed adjacent respectively opposite ends of the compartment. Thus, the belt travels in a path which includes parallel upper and lower runs in which the upper run extends from end to end of the compartment and is disposed between the side walls. Conveyor roller 64 is driven by an electric motor 66 which can be operated by controls (not shown) accessible to service personnel using the walkway 30. For reasons which will become apparent later, the controls are designed so that motor 66 can be used to "inch" conveyor 58 forwardly during loading of compartment 32.

It will be seen that the side walls 46 and 48 of compartment 32 extend upwardly adjacent respectively opposite sides of conveyor 58 for laterally constraining material in said compartment so that the material is maintained on conveyor 58. The side walls include lower portions, such as that indicated at 46*a* in the case of side wall 46, which are inclined between the vertical portion of the wall and the conveyor to assist in constraining the material. A similar inclined portion at the lower end of end wall 38 is indicated at 38*a*. At the opposite (discharge) end of the conveyor, a ramp 68 extends downwardly from the conveyor for facilitating discharge of bags of garbage from the conveyor. A drain pan 70 is provided below conveyor 58 to receive any liquid which may drain from the garbage bags. Pan 70 extends over the full length of conveyor 58 although, for clarity of illustration, the pan is shown partly broken away.

At the second (discharge) end of compartment 32, a closure device 72 is provided for controlling discharge of garbage bags from the compartment. Device 72 includes a slat-type roll-up door 74 which runs in vertical guides 76 and 78 at respectively opposite sides of discharge opening 56. The guides 76 and 78 are in the form of inwardly facing channels which slidably receive opposite side margins of the door 74. A cross member 80 extends over the full width of the apparatus in an overhead position and supports a mandrel 82 onto which door 74 can be wound when the door is to be raised. One of a pair of brackets rotatably supporting mandrel 82 on cross member 80 is shown at 84. Member 80 also supports a reversible electric motor 86 which is drivably coupled by a belt 84 to mandrel 82 for rotating the mandrel in the appropriate direction to raise or lower door 74 as the case may be. Suitable controls (not shown) are provided for motor 86 and are disposed so as to be conveniently accessible to service personnel on walkway 30. Thus, by operating these controls to cause motor 86 to turn in the appropriate direction, mandrel 82 can be turned to wind door 74 onto or off the mandrel as the case may be depending on whether the door is to be raised or lowered.

Similar closure devices for the other two compartments 34 and 36 are visible at 90 and 92 but will not be described in detail since they are essentially similar to device 72. These devices are also provided with independent controls accessible from walkway 30. The openings, (such as opening 54) in the front walls 38 of the compartments are also provided with closure devices similar to device 72. These devices are denoted 94, 96 and 98 for the respective compartments. These devices too are essentially very similar to device 72 and will likewise not be described in detail. It is sufficient to note that each device includes a slat-type roll-up door similar to door 74, which runs and guides attached to the inner surface of front wall 38. The devices include reversible electric motors operable by controls which are accessible to service personnel on walkway 30.

Apparatus 20 also includes a further belt conveyor generally denoted 100 which is positioned to receive material discharged from the compartments 32, 34 and 36 and is operable to deliver said material to a common discharge location. Conveyor 100 is disposed at a lower level than the conveyors of the compartments 32, 34 and 36 and extends generally transversely with respect to those conveyors. An inclined metal chute or slide 102 extends downwardly from the discharge openings of the compartments 32, 34 and 36 to one side of conveyor 100. A vertical retaining wall 104 is provided adjacent the opposite side of conveyor 100 to prevent material spilling off the conveyor. Conveyor 100 is essentially of conventional form and includes an endless belt 106 which extends around two parallel rollers 108 and 110 adjacent respectively opposite ends of the conveyor. An electric motor 112 is provided for driving roller 108 to operate the conveyor and is provided with controls (not shown) accessible from walkway 30. Of course, suitable support structure will be provided for the rollers 108 and 110 and electric motor 112, although for clarity of illustration, this structure has not been shown in the drawings.

Figure 2:
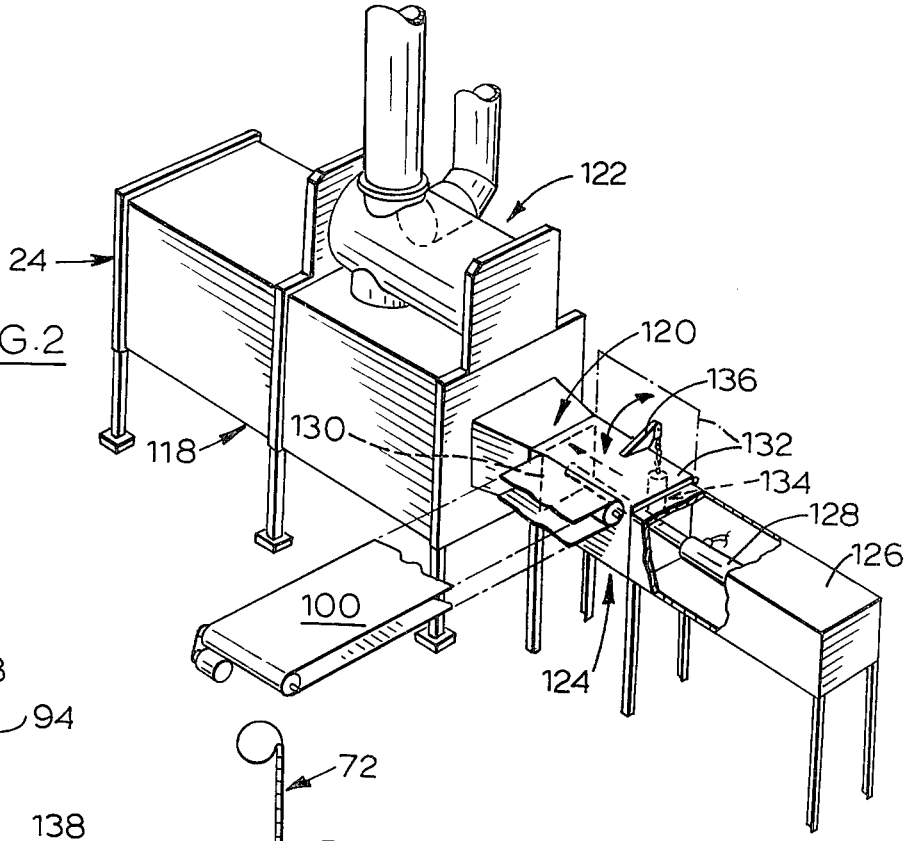
FIG. 2 is a perspective view showing part of the apparatus of FIG. 1 and the associated incinerator; and, FIGS. 3, 4 and 5 are diagrammatic sectional views generally on line X—X of FIG. 1 and illustrate the sequence of operation of the apparatus shown in that view.

As indicated by the arrows denoted 114 and FIG. 1, material discharged from compartments 32, 34 and 36 falls down slide 102 onto conveyor 100 and, by which it is then conveyed to the right as viewed in FIG. 1 to a discharge location indicated generally at 116 and represented by part of the incinerator feeding device 22. The incinerator itself is disposed below the compartments 32, 34 and 36 and is shown in FIG. 2 in association with the feeding device 22. Incinerator 24 is essentially of conventional form and will not therefore be described in detail. For present purposes, it is sufficient to note that the main body of the incinerator is generally indicated at 118 in FIG. 2 and that the incinerator includes an inlet chamber 120 from which material passes into the combustion chamber of the incinerator via an inlet door. Associated heat exchange equipment, also of conventional form is indicated at 122 and forms part of the heating system of the building (not shown).

In FIG. 2, belt conveyor 100 is shown partly broken away in association with the incinerator feeding device 22. Device 22 includes an elongate rectangular box 124 which is open at both ends. One end of the box communicates with the inlet chamber 120 of incinerator 24, while the other end of the box communicates with an extension 126 of box 124. Extension 126 forms a housing for a hydraulic cylinder and ram device 128 which is disposed with its axis horizontal, and the outer end of the ram of which is fitted with a rectangular plate 130 of a shape and size slightly less than the transverse cross-sectional shape of box 124 so that the plate can slide from end to end of the box. Plate 130 in effect forms a movable end wall of box 124. In FIG. 2, the ram of cylinder and ram device 128 is shown fully extended and plate 130 is at the left hand end of box 124 as viewed in that Fig. When the ram has retracted, plate 130 assumes a position adjacent the opposite end of box 124.

The box has a hinged lid 132 which is movable between the closed position in which it is shown in FIG. 2 and the open position shown in FIG. 1. Movement of the lid between its two positions is effected by a further hydraulic cylinder and ram device 134 (FIG. 2) which is mounted in an upright position on a rear wall of box 124, and the ram of which is connected by a link 136 to lid 132. It will be appreciated that, if the ram of device 134 is retracted from the position in which it is shown in FIG. 2, lid 132 will be raised. Conversely, by extending the ram, the lid can be closed.

In practice, the sequence of operation of device 22 will be as follows. The lid 132 of box 124 will initially be in the open position and the ram of cylinder and ram device 128 will be retracted so that plate 130 is at the right hand end of box 124 as viewed in FIG. 2. Garbage bags will then be delivered into the open box by conveyor 100. When the box is full, conveyor 100 will be stopped and lid 132 will be closed by extending the ram of cylinder and ram device 134. The ram of device 128 will then be extended so that plate 130 will slide through box 124 and deliver the garbage into the inlet chamber 120 of the incinerator. The ram of device 128 will then be retracted to return plate 130 to its right hand position ready to receive the next charge of garbage bags. At that time, with the incinerator inlet door open, extension of the ram of device 128 will push the garbage bags from box 124 into inlet chamber 120 and the garbage formerly in chamber 120 will move into the incinerator.

Although not shown in the drawings, it is anticipated that, in practice, suitable control equipment will be provided to allow the operation of feeding the incinerator to proceed automatically. Thus, a photocell arrangement will detect when box 124 is full and will generate a signal to stop conveyor 100 and initiate a sequence control for appropriately operating the cylinder and ram devices 134 (to close lid 132) and 128 (to deliver the garbage into chamber 120).

Figure 3:
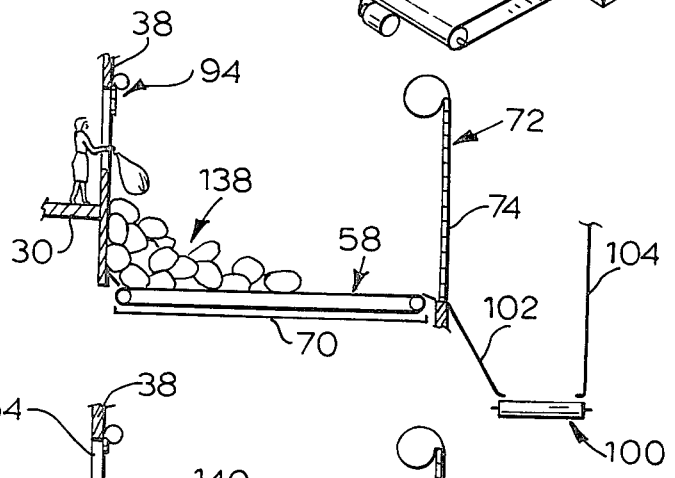
Figure 4:
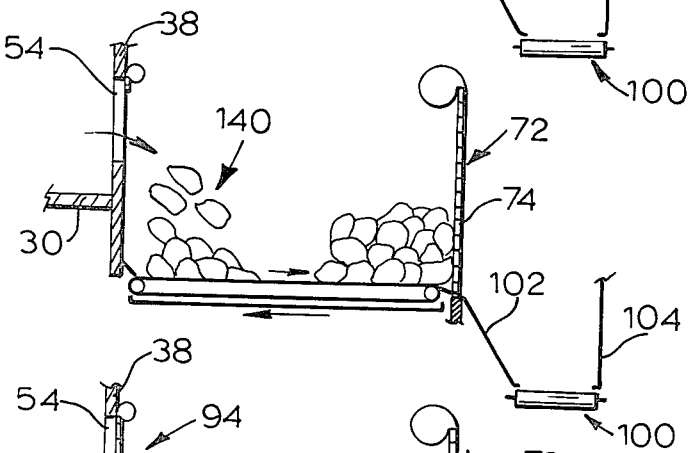
Figure 5:
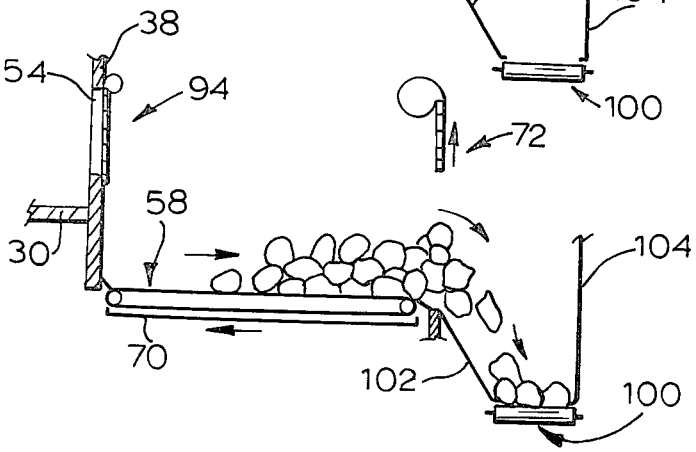

Reference will now be made to FIGS. 3, 4 and 5 in describing the operation of apparatus 20. For convenience, it will be assumed that these views show compartment 32 of the apparatus. In FIG. 3, both the conveyor 58 in compartment 32 and the lower level conveyor 100 are stationary. The closure device 72 for the discharge opening 56 is in its closed position and the corresponding closure device 94 at the first end of the compartment is open. Garbage bags indicated at 138 are shown being loaded into the compartment by way of access opening 54. In a typical situation, this operation will take place over a reasonable period of time as and when garbage becomes available. When a reasonable number of garbage bags have accumulated adjacent the front end wall 38, conveyor 58 is "inched" forward to move the bags of garbage towards closure device 72. The distance through which the conveyor device is moved will be left to the discretion of the operator. In practice, it is probably likely that the operator will move the conveyor through a distance sufficient to cause the bags of garbage to begin to stack up behind closure device 72. This makes room for additional garbage bags to be loaded through opening 54 as indicated at 140 in FIG. 4. If the operator considers it to be necessary, conveyor device 58 can then be operated again to feed these additional garbage bags toward the discharge end of conveyor 58. When it is determined that compartment 32 should be emptied, the closure device 72 is operated to raise door 74 and conveyor 58 is advanced to positively feed the garbage out of compartment 32 through the discharge opening 56. The garbage then falls down slide 102 onto conveyor 100 and proceeds to the incinerator. Obviously, the volume of garbage discharged can be controlled as appropriate by regulating the movement of conveyor 58. In some situations, it may be necessary to feed only a few garbage bags onto conveyor 100, while in other situations, it may be necessary to completely empty the compartment.

The actual sequence of operations involved in discharging the bags of garbage will vary. In some circumstances, it may be sufficient to merely raise the door 74 of closure device 72 without operating conveyor 58. Thus, where the bags of garbage are stacked up behind door 74 and only a few bags are to be discharged, it may be sufficient to simply allow a few bags to fall under gravity onto conveyor 100. However, practical tests have shown that the degree of mutual adherence present in a stack of garbage bags is sufficient that even a relatively high stack will often not fall in such a situation and thus in most cases it will be necessary to advance the conveyor 58 to effect discharge of the bags.

Referring back to FIG. 1, it will be appreciated that bags of garbage can be discharged from the compartments 32, 34 and 36 in any appropriate sequence and in any appropriate volume according to criteria, such, for example as the volume of garbage available, the rate of garbage consumption by the incinerator and ambiant temperature. The apparatus provided by the invention allows great flexibility in catering for a wide range of operating requirements.

In concluding, it should be noted that the preceding description relates to a specific embodiments of the invention only, and that many modifications are possible within the broad scope of the invention.

For example, although the drawings show an apparatus having three compartments there is no limitation to this particular number. In a minimum case, the apparatus might include 2 material receiving compartments, while in another example 4, 5 or even more compartments could be used. Obviously, considerations such as the volume of garbage available in a given period of time will be relevant in determining the number of compartments.

The form of the closure devices used in the compartments may also vary. In the embodiment shown in the drawings, these devices include slat-type roll-up doors. However, there is no limitation to this particular type of device. In another embodiment, solid sliding doors could be used as another alternative. These doors could, for example, be vertically slidable and operable by lifting devices such as hydraulic cylinder and ram units. The closure devices associated with front wall 38 of the apparatus could even be omitted entirely or replaced by cupboard-type doors. Another possible modification in this area would be to replace the relatively small openings in wall 38 (such as opening 54) with openings extending over the full width and height of each compartment for facilitating loading of garbage bags.

In regard to the belt conveyors referred to previously, it is to be understood that the term "belt" is to be interpreted broadly as including any suitable endless structure on which garbage bags may be conveyed. In the illustrated embodiment, the belts are made of lengths of tough rubber or rubber-like material, although other materials could be used. In another embodiment, slat-type conveyor belts could be used. Also, it should be noted that each of the material receiving compartments could include more than one belt conveyor, e.g. two conveyors disposed end to end.

Although the description refers to apparatus for handling garbage in bags, it is to be understood that there is no limitation in this respect. The apparatus could be used for handling garbage in loose form, providing it is relatively dry and otherwise suitable for handling in the apparatus. The apparatus could also be used for handling material other than garbage, e.g. laundry. Another possible modification not shown in the drawings would be to provide pressure sensors in association with the closure devices at the discharge ends of the material receiving compartments. These devices would be set to respond to pressure exerted on the devices by stacked garbage inside the compartment and would be arranged to override the control of the conveyor in the compartment so as to prevent further bags of garbage being fed up against the closure device. This is intended to avoid the possibility that the closure device might become jammed due to excessive pressure exerted on the device by a stack of garbage bags.

The electric motors referred to herein may of course be replaced by hydraulic motors.

I claim:

1. Material handling apparatus comprising:

a plurality of temporary storage compartments each having a first end at which material can be loaded into the compartment and a second end opposite said first end from which material can be discharged, each compartment including: a belt conveyor which forms a bottom wall of the compartment and which extends from said first end to said second end of the compartment, said conveyor being operable periodically to move material loaded into the compartment at said first end longitudinally of the compartment in a direction towards said second end for temporary storage; a first end wall having an opening through which material can be introduced into the compartment generally in the direction in which material is moved through the compartment by said conveyor; side walls extending upwardly adjacent respectively opposite sides of said conveyor for laterally constraining material in said compartment; and closure means at said second end of the compartment providing an obstruction to normally prevent discharge of material from said second end of the compartment and allow material fed towards said second end by said belt conveyor to be accumulated for temporary storage behind said closure means, said closure means being adapted to be opened at appropriate times to allow stored material to be discharged from said compartment by operating said belt conveyor, said closure means comprising a pair of transversely spaced upright guides defining therebetween an opening through which material can be discharged from the compartment, a slat-type roll-up door received in said guides, a mandrel which is rotatable about a longitudinal axis and onto and from which the door can be wound, and means for raising and lowering the door by turning said mandrel;

said compartments all being of substantially the same rectangular shape and size and being disposed side-by-side with said first end walls in alignment, said closure means in alignment, and said conveyor means extending parallel to one another; and, a further belt conveyor extending across said second ends of the compartment in a direction generally normal to said parallel belt conveyors and positioned below said conveyors to receive material discharged from said compartment, said further belt conveyor being operable to deliver said material to a common discharge location laterally of said compartments.

* * * * *